United States Patent [19]

Kovaleski

[11] 4,062,505

[45] Dec. 13, 1977

[54] SNAP-ON, WIRE PAY-OFF CAP ASSEMBLY

[75] Inventor: Joseph J. Kovaleski, Easton, Conn.

[73] Assignee: Wyrepak Industries, Bridgeport, Conn.

[21] Appl. No.: 728,650

[22] Filed: Oct. 1, 1976

[51] Int. Cl.[2] ..... B65H 49/00

[52] U.S. Cl. ..... 242/128; 242/147 RR

[58] Field of Search ..... 242/47.01, 128, 147 R–147.1; 57/34 R, 58.86, 59, 58.82

[56] References Cited

U.S. PATENT DOCUMENTS

| | | | |
|---|---|---|---|
| 3,202,380 | 8/1965 | Hosbein | 242/128 |
| 3,972,489 | 8/1976 | Kovaleski | 242/128 |
| 3,995,786 | 12/1976 | Deniega | 242/47.01 |
| 3,997,127 | 12/1976 | Kovaleski | 242/128 |

*Primary Examiner*—Leonard D. Christian
*Attorney, Agent, or Firm*—H. Gibner Lehmann; K. Gibner Lehmann

[57] ABSTRACT

A snap-on, wire pay-off cap assembly to facilitate the unreeling of wire past one end of a wire filled spool, comprising a wheel adapted to be engaged by the wire being de-reeled, a circular brush disposed broadside to the wheel and having tines extending past the wheel periphery, a support member rotatably mounting the wheel and fixedly mounting the brush in their respective operative positions, and an operable clamp carried by the support member and adapted to engage the rim of one of the spool flanges for holding the cap assembly captive at one end of the spool. The clamp includes several radially extending arms which have hooks at their ends, to latch over the rim of the flange. Spring means associated with one of the arms biases it in a radially inward direction to thereby maintain the engagement of the hooks and the rim. The arrangement is such that the operator can grasp the assembly either by the wheel or else by one of the arms, latch the spring-loaded arm over the rim to extend the spring and then latch the remaining arms over other circumferentially spaced areas of the rim. The quick installation and removal of the cap assembly enables high speed and trouble-free operation to be realized.

10 Claims, 6 Drawing Figures

12a
84a
60a
67
50a
62a
49a
20a
54a
64a
66a
80a
52a
46a
66b
68
70
72
58a
10a
48a
56a
82a
21a
32a
33a
23a
22a
36a
29
42a
44
34
6
26a
47a
28a
24a
12a

SNAP-ON, WIRE PAY-OFF CAP ASSEMBLY

CROSS REFERENCES TO RELATED APPLICATIONS AND PATENTS

U.S. Pat. No. 3,425,647, issued Feb. 4, 1969 to Joseph J. Kovaleski, and entitled "WIRE TAKE-OFF DEVICE."

Co-pending application of Joseph J. Kovaleski, U.S. Ser. No. 563,792, filed Mar. 31, 1975, and entitled "SPOOL HANDLING DOLLY," now U.S. Pat. No. 3,995,758 dated Dec. 7, 1976.

Co-pending application of Joseph J. Kovaleski, U.S. Ser. No. 725,095, filed Sept. 17, 1976, and entitled "WIRE PAY-OFF CAP ASSEMBLY FOR WIRE SPOOLS."

Co-pending application of Joseph J. Kovaleski, U.S. Ser. No. 578,364, filed May 16, 1975, and entitled "TENSION BRUSH WITH ADJUSTABLE BRAKE," now U.S. Pat. No. 3,972,489 dated Aug. 3, 1976.

Co-pending application of Joseph J. Kovaleski, U.S. Ser. No. 620,319 filed Oct. 7, 1975, and entitled "SUPPORTING FIXTURE FOR WIRE CARRYING SPOOLS" now U.S. Pat. No. 3,998,403 dated Dec. 21, 1976.

Co-pending application of Joseph J. Kovaleski, U.S. Ser. No. 563,787, filed Mar. 31, 1975, and entitled "TENSION BRUSH FOR WIRE SPOOL AND METHOD FOR MAKING SAME," now U.S. Pat. No. 3,998,403 dated Dec. 21, 1976.

Co-pending application of Joseph J. Kovaleski, U.S. Ser. No. 622,025 filed Oct. 14, 1975, and entitled "QUICK-CONNECT WIRE PAY-OFF CAP ASSEMBLY," now U.S. Pat. No. 3,997,127 dated Dec. 14, 1976.

BACKGROUND

This invention relates generally to wire spooling equipment, and more particularly to devices for facilitating the de-reeling of wire from a spool.

In U.S. Pat. No. 3,425,647, issued to Joseph J. Kovaleski on Feb. 4, 1969 there is shown a pay-out cap assembly comprising a freely rotatable wheel and stationary tension brush for de-reeling wire off the free end of the spool. In order to install the cap assembly at one end of the spool it is necessary to raise the spool end by lifting or tilting the spool, after which the assembly can be secured in place. In the past, special hubs or fixtures of one sort or another have been employed to retain such an assembly in its operative position. However, these items were generally cumbersome, and time-consuming to install. Also, problems associated with slightly differing spool bore diameters often made high speed operation of pay-out equipment difficult or impossible to realize.

SUMMARY

The above drawbacks and disadvantages of prior cap assemblies for wire spools are obviated by the present invention, which has for an object the provision of a novel and improved quick-connect snap-on cap assembly which is simple in construction, reliable in operation, and which features especially quick installation on and removal from existing spools. A related object of the invention is the provision of a cap assembly as above, wherein no special tools are required for installation, and wherein few separate parts are involved whereby the fabrication cost is kept low.

The above objects are accomplished by a wire pay-off cap assembly for use with flanged, wire-filled spools to control the unreeling of wire past the ends thereof, comprising a support member, a flanged wheel carried on said support member, a circular tension brush disposed broadside to the wheel and having a plurality of radially disposed tines extending past the wheel periphery, and a unique clamping means connected with the support member and engageable with the rim of one flange of the spool for releasably securing the member, wheel and brush at one end of the spool with the wheel broadside to the spool end. The arrangement is such that it enables an especially quick snap-on installation of the cap assembly to a particular spool to be had, all without the need for special tools or equipment. Removal of the cap assembly is also readily accomplished.

Features of the invention reside in the provision of a cap assembly as above characterized, which is sturdy and rugged in construction, and which employs few moving parts, thus being economical to fabricate and assemble.

Other features and advantages will hereinafter appear.

In the drawings, illustrating several embodiments of the invention:

Figure 1:
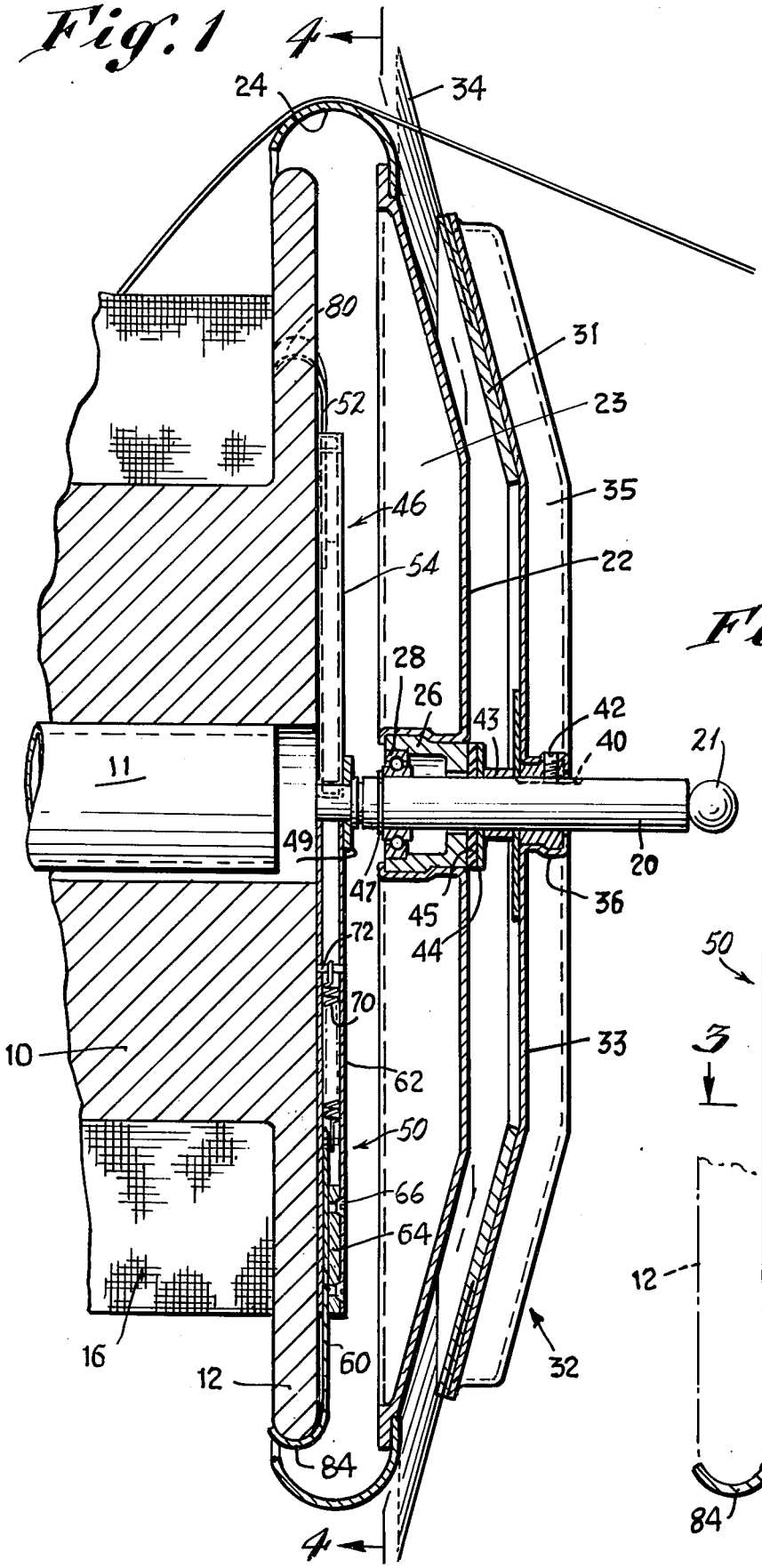
FIG. 1 is a vertical sectional view of the snap-on cap assembly of the present invention, shown installed on a flanged, wire-filled spool from which pay-out is ready to commence.

Referring first to FIG. 1, and in accordance with the present invention there is illstrated the novel and improved snap-on wire pay-off cap assembly for use with flanged spools, to control the unreeling of wire past the ends thereof.

The spool 10 is supported on a horizontal member 11 with the cap assembly installed on one of the spool flanges 12, for effecting pay-off of wire to an idler or take-up mechanism (not shown). The spool is shown partially filled with wire 16.

The improved snap-on cap assembly of the present invention includes a support member comprising a shaft 20 on which there is rotatably carried a take-off wheel 22 having a peripheral flange 24 extending past the periphery of the spool flange 16. The wheel may be constituted as two pieces, as illustrated and described in my co-pending application U.S. Ser. No. 725,095 identified above. Alternately, it can be constituted as a single sheet metal part. The wheel 22 is carried on a molded plastic sleeve 26 which in turn rides on a ball bearing 28 carried on the shaft 20. Also carried by the latter is a circular brush 32 having radially extending tines 34 embedded in a conical disk 31 glued to the body, the tines being disposed adjacent the periphery of the wheel 22 and adapted to be brushed by the wire as it is being paid out past the wheel flange 24. The brush 32 has a body 33 including multiple, radially extending stiffening ribs 35, and a hub 36 secured by a set screw 42 on a flattened portion 40 of the member 20. A spacer 43, metal washer 44 and felt washer 45 are between the hub 36 and wheel 22.

Figure 4:
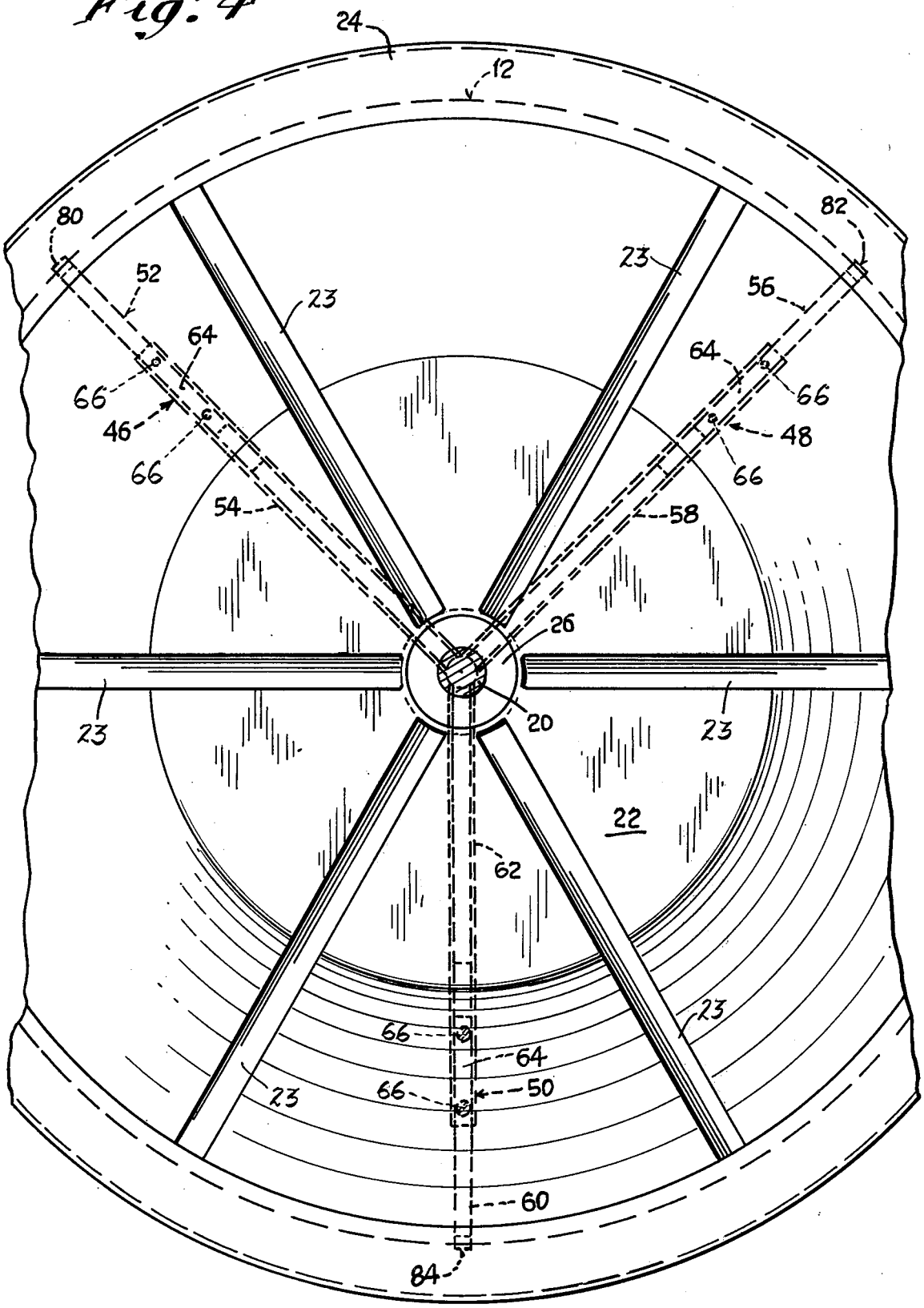
FIG. 4 is a section taken on line 4—4 of FIG. 1.

The bearing 28 is held against axial movement by a ring 47 received in a circumferential groove in the shaft 20. In this way, the stationary felt washer 45 bears against the sleeve 26 of the wheel and applies a braking force thereto for improved control over the unreeling operation under conditions of variable speed pay-out. Adjustment of the drag or braking force applied to the wheel can be effected by loosening the set screw 42 and sliding the brush 32 toward the wheel 22 just slightly, thereby compressing the felt washer 45 and increasing the drag on the sleeve 26. The wheel 22 can optionally include a plurality of radially extending stiffening ribs 23 for added stiffness, as shown in FIG. 4. A knob 21 facilitates grasping the assembly during installation or handling.

Figure 2:
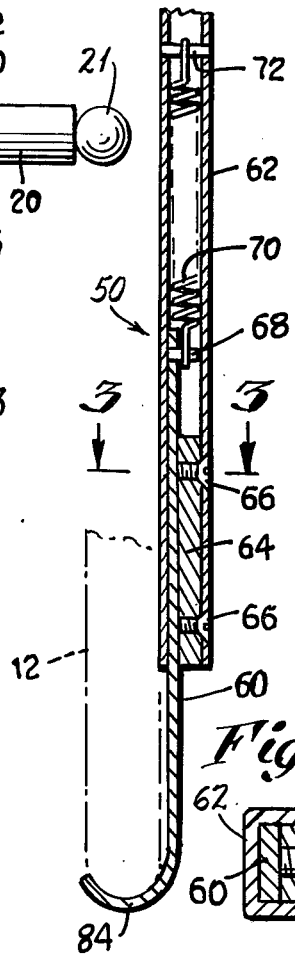
FIG. 2 is an enlarged fragmentary view of one of the arms of the cap assembly of FIG. 1.
Figure 3:
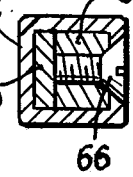
FIG. 3 is a section taken on line 3—3 of FIG. 2.

At the inner end of the support member 20 there is carried a hub in the form of a washer 49 to which three radially disposed arms 46, 48 and 50 are welded, these being particularly illustated in dotted outline FIG. 4. The washer 49 is welded to the shaft 20, and the latter has three radially extending recesses to receive the ends of the arms. The arm 46 is constituted as a pair of inner and outer telescoping members 52, 54 respectively. Similarly, the arm 48 includes telescoping members 56, 58, and the arm 50 includes members 60, 62. As shown, the three large-diameter members 54, 58 and 62 are tubular; the members 54 and 58 carry mounting blocks 64 having threaded apertures to receive set screws 66 which clamp against the respective inner telescoping member 52 or 56 to hold them in predetermined positions with respect to their outer members. Adjustment in the overall length of the arms 46 or 48 is accordingly effected by loosening the set screws 66 and sliding the inner member 52, 56 to its desired position, to accommodate a particular spool size being employed. In FIG. 2 the member 60 carries a pin 68 near its inner end, and one end of a tensile spring 70 is secured thereto. The spring 70 is completely encased in and concealed by the outer telescoping member 62, and has its other end secured to a cross pin 72 carried by the member 62. A block 64 is provided in the member 62, secured by screws 66 and constituting a guide for the member 60 to minimize binding thereof, and to prevent turning of the member 60 with respect to the member 62. The members 52, 56 and 60 constitute hook portions of the arms 46, 48 and 50 respectively, having hooked ends 80, 82 and 84 respectively, which are adapted to be latched over the rim of the spool flange 12 as shown in FIG. 1 when the cap assembly is installed; the members 52, 56 and 60 are preferably constituted or hardened steel or spring steel such that they will retain their shape even after prolonged periods of use.

In FIG. 4, during the installation on a spool, of a typical snap-on pay-off cap assembly constructed in accordance with the present invention, the members 52, 56 are initially positioned to the approximate locations with respect to their outer telescoping members 54, 58 to accomodate the particular spool size being employed. To install the cap assembly, the operator merely grasps the wheel 22 with both hands, latches the hook 84 over the spool flange, pulls upwardly to stretch the spring 70 and enable the hooks 80, 82 to first by-pass and then latch over the opposite side of the flange 16. Upon release of the assembly, the spring 70 maintains the engagement of all three hooks with the flange. Removal of the cap assembly is accomplished as readily.

The above construction is seen to have the advantage of extreme simplicity, yet it provides a very satisfactory solution to the problem of quickly and easily securing a cap assembly to one end of a spool. The construction is capable of use with any flanged spool, regardless of whether the latter is positioned horizontally as shown in FIG. 1, such as on a spindle attached to a spool-supporting rack, or inclined to the horizontal, on a tilting fixture such as that shown and described in the application of Joseph J. Kovaleski, U.S. Ser. No. 620,319 filed Oct. 7, 1975 and entitled "SUPPORTING FIXTURE FOR WIRE CARRYING SPOOLS." Accordingly, great flexibility is realized, with high speed pay-out of wire being readily accomplished.

Figures 5, 6:
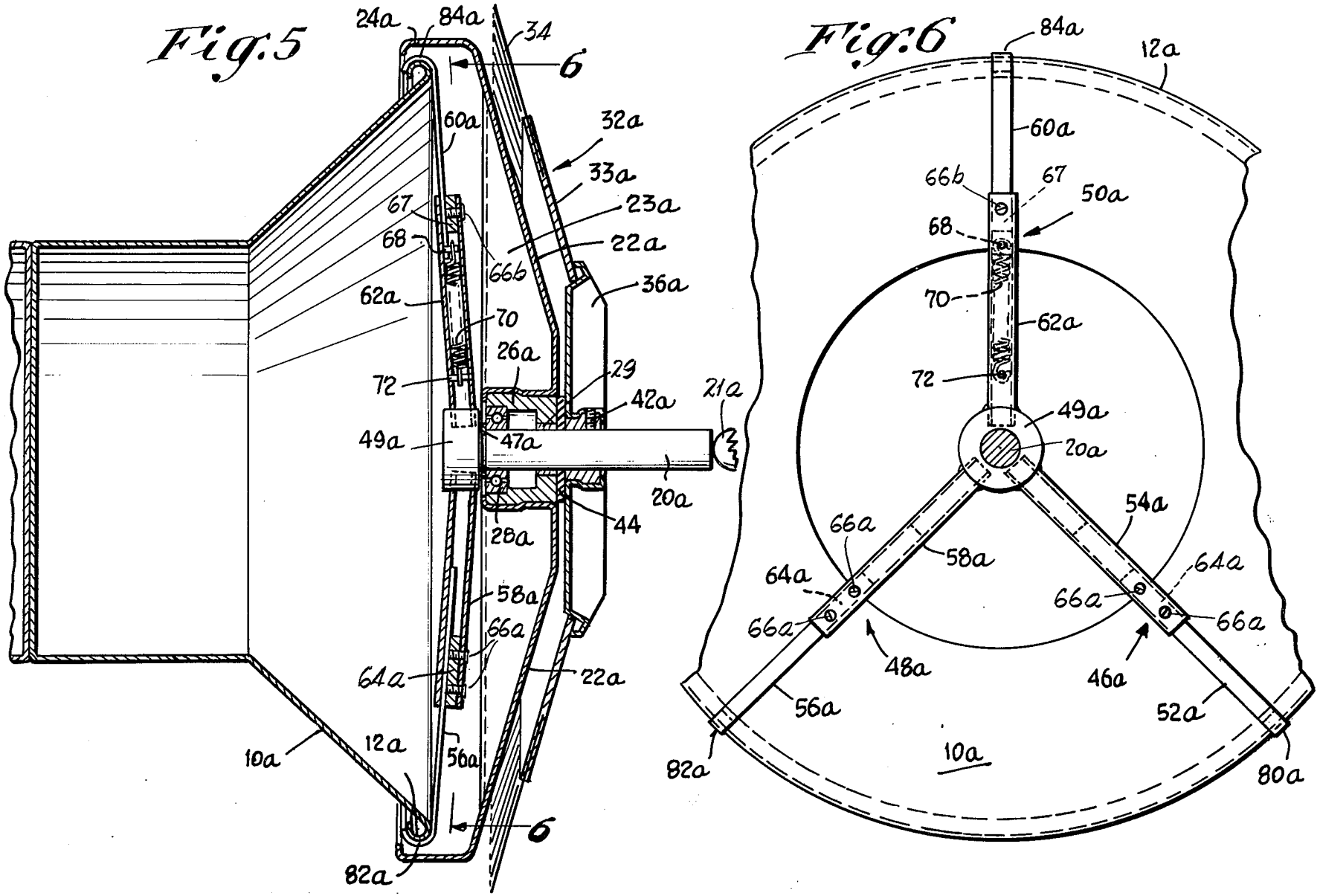
FIG. 5 is a view like FIG. 1 of a somewhat modified snap-on cap assembly, constituting another embodiment of the invention.
FIG. 6 is a section taken on line 6—6 of FIG. 5.

Another embodiment of the invention is illustrated in FIGS. 5 and 6, showing a modified spool **10*a* constituted of sheet metal, and a modified pay-out cap assembly for use therewith. The cap assembly includes a stationary brush 32*a* comprising a body 33*a* and a hub 36*a*, with a plurality of radially extending tines 34 embedded in the body 33*a*. The hub is secured on the shaft 20*a* by means of a set screw 42*a*, as in the previous embodiment. A knob 21*a* facilitates grasping and handling of the cap assembly. Also carried on the shaft 20*a* is a rotatable wheel 22*a* having multiple stiffening ribs 23*a* and a somewhat flattened peripheral flange 24*a*. The wheel 22*a* is carried on a molded bushing 26*a* and a ball bearing 28*a*. A bronze bearing 29 is also carried by the bushing 26*a*, and turnably engages the shaft 20*a*. A retainer washer 47*a* bears against the inner race of the bearing 28*a* and positions the wheel 22*a* axially. Welded to the shaft 20*a* is a solid block 49*a* constituting a hub, and including three radially extending recesses which receive three arms 46*a*, 48*a* and 50*a*. As shown in FIG. 6, the arms welded in place on the hub 49*a***.

As in the previous embodiment, the arm **48*a* is constituted of a tubular outer portion 58*a* and a telescoping inner portion or hook portion 56*a* and including a hooked end 82*a*. A guide block 64*a* is carried by the portion 58*a* and multiple screws 66*a* provided for locking the portion 56*a* in a fixed radial position. Similarly, the arm 46*a* includes a tubular portion 54*a* and a hook portion 52*a* having a hook 80*a*, and including a guide block 64*a*. The arm 50*a* is spring-biased, comprising a tubular portion 62*a* and a hook portion 60*a* having a hooked end 84*a*. A tensile spring 70 extends between pins 68 and 72 carried respectively by the member 60*a* and 62*a*, for biasing the hook portion 60*a* radially inward. The tubular portion 62*a* also includes a small guide block 67 having a single screw 66*b* securing it in place, for minimizing binding of the hook portion 60*a* during its sliding movement, and for preventing turning thereof with respect to the tubular portion 62*a***.

The operation of this embodiment is substantially the same as that of the first embodiment, in that during installation, the hook **84*a* is first latched over the flange 12*a*, and the cap assembly pulled downwardly in FIG. 6, until the hooks 80*a* and 82*a* bypass the flange, after which the cap assembly is urged toward the spool 10*a*, and the hooks 80*a*, 82*a*** latched in position.

With the hook portions **60*a*, 52*a* and 56*a*** being constituted of spring steel, the likelihood of permanent deformation or damage thereto is greatly minimized. Moreover, the improved cap assembly of the present invention can be readily installed by one person, even where relatively heavy steel wheels are employed. This is important where high speed operation involving multiple spools is desired.

From the above it can be seen that I have provided novel and improved, snap-on pay-off assemblies employing few moving parts, the assemblies being especially adaptable to a wide variety of spooling installations. The devices can be readily installed on and removed from existing spools without the use of special equipment or tools, and are thus seen to represent a distinct advance and improvement in the technology of wire de-reeling equipment.

Variations and modifications are possible without departing from the spirit of the invention.

I claim:

1. A snap-on wire pay-off cap assembly for use with wirefilled, flanged spools to control the unreeling of wire past the ends thereof, comprising in combination:
   a. a wheel having a rim adapted for engagement with the wire being unreeled,
   b. a circular brush disposed broadside to the wheel, having tines extending past the wheel periphery,
   c. a support member mounting said wheel and fixedly mounting said brush in their respective operative positions, and
   d. clamping means connecting with said support member and engageable with the rim of one flange of the spool for releasably securing the member, wheel and brush at one end of the spool with the wheel broadside to the spool flange.

2. The invention as defined in claim 1, wherein:
   a. said clamping means comprises a plurality of radially extending arms carried by said support member,
   b. said arms respectively having hook portions engagable with the rim of said one spool flange for releasably holding the assembly captive.

3. The invention as defined in claim 2, wherein:
   a. said arms are constituted of spring steel, to thereby retain their shape even after extended periods of use.

4. The invention as defined in claim 2, and further including:
   a. spring means associated with one of said arms for biasing it radially inward, thereby maintaining engagement of all the arms with the spool flange when the assembly is installed thereon.

5. The invention as defined in claim 4, wherein:
   a. said one arm is constituted as a pair of telescoping members,
   b. said spring means being disposed within the outer one of said telescoping members.

6. The invention as defined in claim 2, wherein:
   a. said wheel includes a peripheral flange extending radially past the locations of the hook portions, such that wire being paid out past the end of the spool cannot become tangled or fouled thereon.

7. The invention as defined in claim 1, wherein:
   a. said clamping means comprising at least three radially extending arms carried by the support member,
   b. said arms respectively having hook portions engageable with the rim of the spool flange to releasably hold the assembly captive thereon,
   c. two of said arms having means enabling them to be adjustable in length,
   d. a third arm including spring means for biasing the hook portion thereof radially inward so as to maintain engagement of the adjustable arms with the spool flange when the assembly is installed thereon,
   e. said arms including means for holding the hook portions against turning, all of said hook portions facing in one direction toward the spool flange,
   f. said arms being juxtaposed to said wheel and extending from points adjacent the wheel axis, outwardly to points disposed about the wheel axis.

8. The invention as defined in claim 7, wherein:
   a. the radially extending arms are constituted each of a plurality of parts,
   b. one part of each arm having the said hook portion and being of non-circular cross-section,
   c. another part of each arm having guide means in which the one part is received.

9. The invention as defined in claim 8, and further including:
   a. manually operable means for locking parts of said two arms respectively, in adjusted, extended or retracted positions.

10. The invention as defined in claim 1, wherein:
   a. said support member comprises a shaft carrying said wheel and said brush,
   b. a hub carried on said shaft,
   c. said clamping means comprising at least three radially extending arms connected with said hub,
   d. said arms each comprising a tubular portion welded to said hub and a hook portion engageable with the rim of the spool flange so as to releasably hold the assembly captive thereof,
   e. said hook portions being constituted of spring steel and being telescopically received in said tubular portions respectively,
   f. two of said arms having guide means including blocks respectively carried in the tubular portions thereof for enabling the hook portions to be adjustably movable in the respective tubular portions,
   g. the thrid arm having a spring carried within its tubular portion, for biasing the hook portion radially inward so as to maintain engagement of the remaining two arms with the spool flange when the assembly is installed thereon,
   h. a pair of pins carried respectively by the hook portion and the tubular portion of the third arm, engageable with opposite ends of the spring for transmitting force from the same,
   i. said blocks holding the associated hook portions against turning, all of said hook portions extending in one direction toward the spool flange,
   j. said arms being juxtaposed to said wheel and extending from points adjacent the wheel axis, outwardly to points disposed about the wheel axis.

* * * * *

UNITED STATES PATENT OFFICE

CERTIFICATE OF CORRECTION

Patent No. 4,062,505 Dated December 13, 1977

Inventor(s) Joseph J. Kovaleski

It is certified that error appears in the above-identified patent and that said Letters Patent are hereby corrected as shown below:

Column 5, line 14, "wirefilled" should read --wire-filled--.

Column 5, line 23, "connecting" should read --connected--.

Column 5, line 58, "comprising" should read --comprises--.

Column 6, line 45, "thrid" should read --third--.

Signed and Sealed this

Fourth Day of April 1978

[SEAL]

Attest:

RUTH C. MASON
Attesting Officer

LUTRELLE F. PARKER
Acting Commissioner of Patents and Trademarks